United States Patent [19]

Gay

[11] 4,226,380

[45] Oct. 7, 1980

[54] FABRIC UNROLLING DEVICE

[75] Inventor: John W. Gay, Westminster, S.C.

[73] Assignee: Phillips Petroleum Company, Bartlesville, Okla.

[21] Appl. No.: 7,522

[22] Filed: Jan. 29, 1979

[51] Int. Cl.[3] ..... B65H 75/02

[52] U.S. Cl. ..... 242/55

[58] Field of Search ..... 242/55, 86.52, 85, 86.3, 242/86.4, 86.6–86.64, 94, 1, 68, 68.4, 68.6, 71.9, 96, 71.8; 414/911, 910; 294/4; 224/162, 45 R, 45 P

[56] References Cited

U.S. PATENT DOCUMENTS

| | | | |
|---|---|---|---|
| 15,042 | 6/1856 | Longley . | |
| 159,864 | 2/1875 | Topliff . | |
| 1,341,484 | 5/1920 | Starratt | 242/94 |
| 1,499,574 | 7/1924 | Evans . | |
| 2,425,827 | 9/1947 | Rancourt | 242/71.8 X |
| 2,843,414 | 7/1958 | Findiesen | 294/4 |
| 3,840,198 | 10/1974 | Moore | 242/71.9 |
| 3,913,854 | 10/1975 | McClure | 242/86.52 X |

*Primary Examiner*—John M. Jillions

[57] ABSTRACT

A device for unrolling a roll of fabric or the like supported on a roll core comprising a pair of endcaps secured under tension to opposite ends of the roll core and handle means attached to the end caps in such a manner as to allow the roll core to rotate.

6 Claims, 2 Drawing Figures

FABRIC UNROLLING DEVICE

The present invention relates to a fabric unrolling device.

Laminate systems such as those used as pond and ditch liners, roofing, roadbed paving and the like, are well known. In one such system, as asphaltic coating is applied to the surface to be coated, a sheet material is laid down over the asphaltic coating and a second asphaltic layer such as asphaltic concrete is applied over the sheet material.

The sheet materials commonly used in such laminate systems include woven fibrous fabric materials, woven wire mesh, felt paper, nonwoven polymeric fabric materials and the like. Such sheet materials are supplied in rolls of varying length and width. Of particular interest are nonwoven sheet materials formed from polypropylene fibers.

It is highly desirable for the sheet material to be applied to the asphaltic undercoat uniformly in as straight a path as possible, without wrinkles, and under at least minimal longitudinal tension. Application of the sheet material leaves no room for error; it is virtually impossible to reapply the fabric after it has been taken up because of an error in laying.

One device which has been found in providing better control when unrolling such fabric rolls is disclosed in U.S. Pat. No. 3,913,854. While that device is very useful under some applications, it is quite complex mechanically and it is quite bulky. Generally, the device requires the employment of some sort of motor vehicle.

Often it is desired to unroll such fabric upon terrain that does not readily permit travel by a motor vehicle. Accordingly, there is a need for a light and mechanically simple device which will allow such fabric rolls to be unrolled manually.

An object of the present invention is to provide a light, mechanically simple device for unrolling fabric rolls. Other objects and advantages of the invention will be apparent from the following description and the accompanying drawings, of which:

Figure 1:
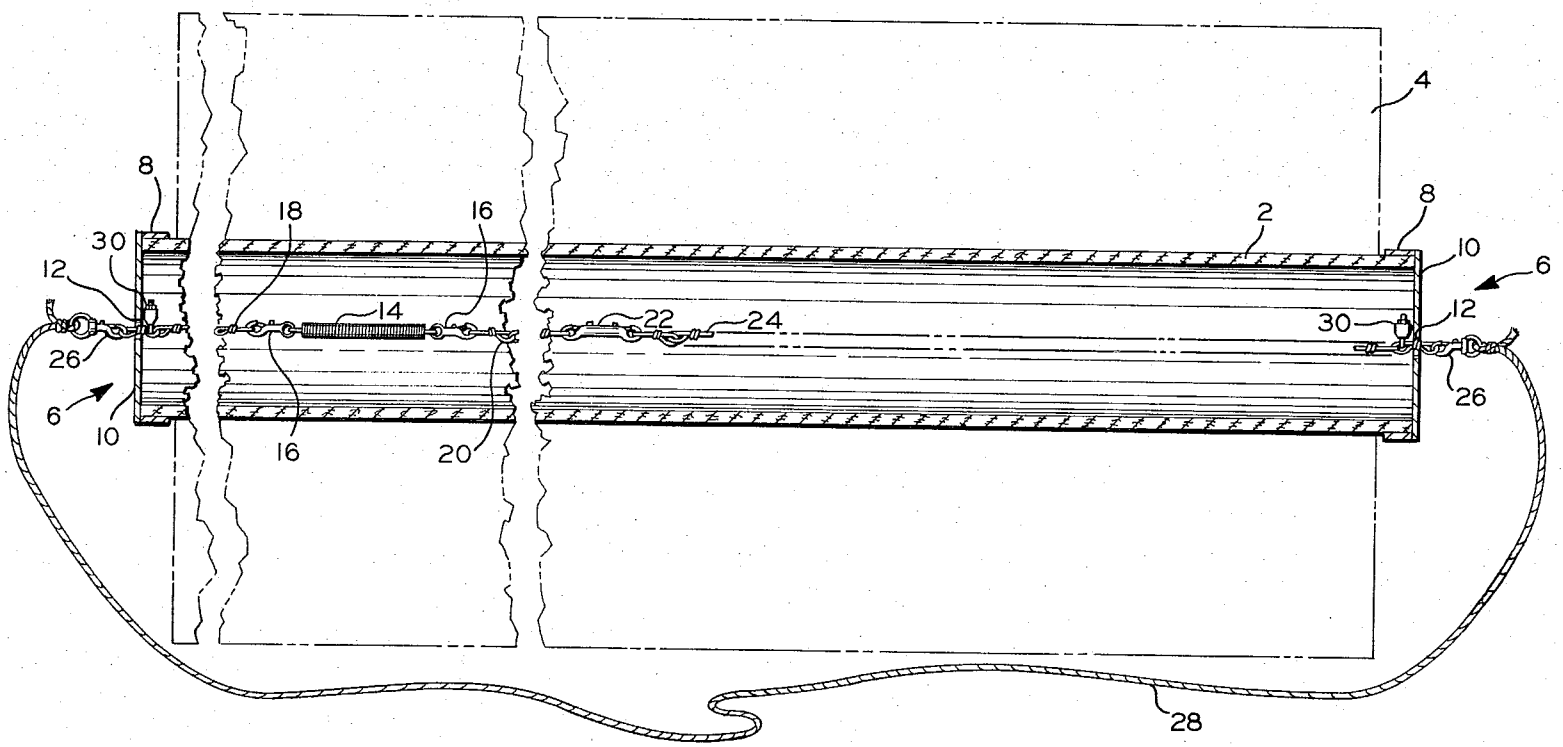
FIG. 1 is fragemented diagrammatical cross-sectional view of an embodiment of the instant invention.

In accordance with the present invention there is provided a device for unrolling a roll of fabric or other material supported on a roll core, said device comprising a pair of end caps adapted to fit over the opposite ends of the roll core, a spring means adapted for being passed through said roll core and attached to the respective end caps to put tension on the end caps to clamp the roll core between the end caps, spring attachment means for securing said spring means to said end caps, handle attachment means adapted to be secured to the end caps and adapted to permit the end caps to rotate relative thereto, and a handle means secured to said handle attachment means. Roll cores used with the invention are well known in the art and can be made of spiral wound paperboard or the like.

The end caps can be employed in any suitable form. The end caps could for example be nearly flat disks larger than the hole in the roll core. Since the end of the roll cores generally extend slightly beyond the outer ends of the fabric roll, it is preferable for the end caps to include flange portions which slide over the outer surface of the exposed portion of the roll core. These flange portions help to insure that the end caps will not be accidentally displaced when the device is being utilized. In especially preferred embodiments the flange portion is generally cylindrical so that it totally surrounds the outer portion of the exposed end of the roll core. The end caps can be constructed of any suitable material as for example, mild steel.

The spring means can likewise be constructed of any suitable material. In a preferred embodiment the spring means comprises a heavy duty steel spring having chain attached to each end. In an especially preferred embodiment the chain attached to one end of the spring is larger than the chain attached to the other end of the spring such that the device can be used on roll cores of different length merely by attaching different links of the larger chain to the respective end cap or by removing or adding links of chain.

The handle means can be constructed in any fashion which will permit the device to be used to unroll fabric. If the device is to be operated by two persons, handles can be employed which allow unrolling of the fabric as each walks either along side or in front of the device. Preferably handle means are provided which permit one person to control the unrolling of the device. Such can be accomplished by use of a single length of rope, chain, etc., as the handle means. Each free end of the rope, chain, etc., is attached to one of the handle attachment means. With such an arrangement the operator need only grab the handle means somewhere near the center and begin to pull. The length of the handle means can be readily selected to assure that the operator does not pull the fabric roll up against his feet as he unrolls fabric. Employing chain, rope, or the like, for the handle means is particularly useful in that it results in a device which can be stored in a very small space. Suitable relatively inflexible handles, i.e. metal tubing, could of course be employed, but such results in a device which is not as easily stored or transported as one having flexible handle means.

Figure 2:
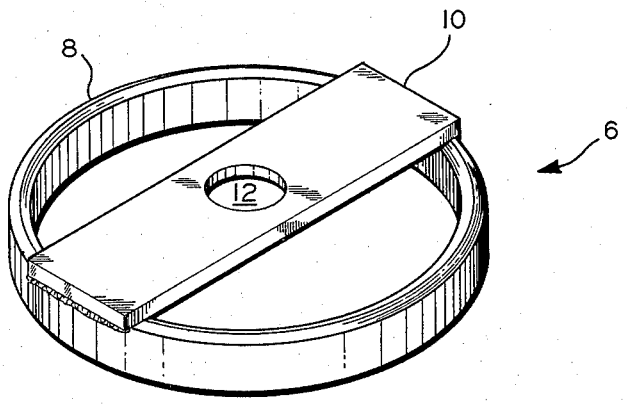
FIG. 2 is a perspective view of the end cap of the device of FIG. 1.

A further understanding of the present invention will be provided by referring to the attached drawings. In the drawings, identical numbers refer to identical parts:

FIG. 1 illustrates a specific embodiment of the present device. In FIG. 1 there is illustrated a fabric roll core 2 having a roll of fabric 4, illustrated diagrammtically by phantom lines. Each end of the roll core 2 has applied thereon an end cap 6. The specific end cap 6 is most clearly illustrated in FIG. 2. The end cap comprises a cylindrical ring 8 adapted to fit around the outer end of the roll core 2. Secured to the ring 8 by welding there is a flat bar 10 having a hole 12 through its center.

Inside the roll core 2, there is a spring 14 having snaps 16 attached to each end. A first length of chain 18 is attached to one of the snaps 16 and extends outward through the hole 12 in the respective end cap 6. The other snap 16 is attached to a second length of chain 20 which in turn is connected to a snap 22 which is further connected to a third length of chain 24. The third length of chain 24 extends outward through the hole 12 in the other end cap 6. A swivel snap 26 is attached to the end of the chain extending through the hole in each end cap 6. A length of rope 28 is attached to each of said swivel snaps 26.

Also, inside the roll core 2 and adjacent the end caps 6, there are cable clamps 30 attached to the chains 18 and 24 in such a manner as to preclude outward movement of the chains through the holes 12 of the end caps 6.

The swivel snaps 26 and the cable clamps 30 are attached such that there is tension holding both end caps on the roll core 2.

To use the device illustrated one only has to secure the free leading end of the fabric and walk away holding the handle. A spring tension is selected that will assure that the end caps remain in place as illustrated in the attached drawings. The direction of travel can be varied by applying more pulling force to one end of the roll.

It is to be understood that the attached drawings merely illustrate one embodiment of the present invention. Various modifications can be made in view of the foregoing disclosure without departing from the spirit or the scope of the invention.

What is claimed is:

1. A device for unrolling a roll of fabric or the like supported on a roll core, said device comprising a pair of end caps adapted to fit over the opposite ends of the roll core, a spring means adapted for being passed through said roll core and attached to the end caps to put tension on the end caps so that the roll core is clamped between said two end caps, spring attachment means for securing said spring means to said end caps, handle attachment means adapted to be secured to the end caps and adapted to allow the end caps to rotate relative to said handle attachment means, and handle means secured to said handle attachment means wherein said spring means is a spring having each end connected to a chain, said end caps each have a hole through which the chain can be passed, said spring attachment means comprises a stop means which will limit the extent that the chain can be pulled outward through the hole in the end caps and swivel means which will prevent the chain from being pulled back into the roll core, and said handle attachment means comprises a loop on said swivel means.

2. A device according to claim 1 wherein the spring is attached to each said chain by snap means which permit each said chain and the spring to be easily disconnected.

3. A device according to claim 2 wherein one of the two chains is longer than the other of said chains.

4. A device according to claim 3 wherein the longer of said chains has along its length at least one snap means which will permit a portion of said longer chain to be easily removed.

5. A device according to claim 4 wherein each said swivel means is a swivel snap.

6. A device according to claim 5 wherein the handle means is a length of rope having each end attached to the loop of a separate one of said two swivel snaps.

* * * * *